United States Patent [19]

Jacobs et al.

[11] Patent Number: 4,929,173

[45] Date of Patent: May 29, 1990

[54] HEATING APPLIANCE WITH COMBUSTION AIR PREHEAT

[75] Inventors: Thomas G. M. Jacobs, Boxmeer; Clemens J. M. De Vroome, Beugen, both of Netherlands

[73] Assignee: Stork Contiweb B.V., Netherlands

[21] Appl. No.: 303,484

[22] Filed: Jan. 27, 1989

[30] Foreign Application Priority Data

Jan. 29, 1988 [NL] Netherlands ..... 8800226

[51] Int. Cl.[5] ..... F23D 11/44

[52] U.S. Cl. ..... 431/215; 126/91 A

[58] Field of Search ..... 237/70; 431/215, 238; 126/91 A, 92 B; 432/222, 223

[56] References Cited

U.S. PATENT DOCUMENTS

| | | | |
|---|---|---|---|
| 3,923,449 | 12/1975 | Brock . | |
| 4,038,022 | 7/1977 | Blackman | 431/215 X |
| 4,140,467 | 2/1979 | Ellison et al. . | |
| 4,508,501 | 4/1989 | Kuhn | 126/91 A X |

FOREIGN PATENT DOCUMENTS

| | | | |
|---|---|---|---|
| 22048 | 5/1872 | Australia . | |
| 0066661 | 12/1982 | European Pat. Off. . | |
| 0127697 | 12/1984 | European Pat. Off. . | |
| 1208843 | 1/1966 | Fed. Rep. of Germany | 126/91 A |
| 2412446 | 9/1975 | Fed. Rep. of Germany . | |
| 2410800 | 6/1979 | France . | |
| 2526139 | 11/1983 | France . | |
| 8401021 | 3/1984 | PCT Int'l Appl. . | |
| 2059032 | 4/1981 | United Kingdom . | |

*Primary Examiner*—Henry A. Bennet
*Assistant Examiner*—John Sollecito
*Attorney, Agent, or Firm*—Ostrolenk, Faber, Gerb & Soffen

[57] ABSTRACT

A heating appliance particularly for a drier of a web of material comprising a combustion unit having a burner and a combustion chamber. The combustion chamber consists of an elongated first section extending away from the burner and merging into a second portion via a bend of 180° said two portions defining an U-shaped path for the combustion gases and being approximately of equal lengths. The combustion chamber also being provided with one or more discharge openings for discharging part of the combustion gases, said opening(s) being controllable by means of a valve.

5 Claims, 1 Drawing Sheet

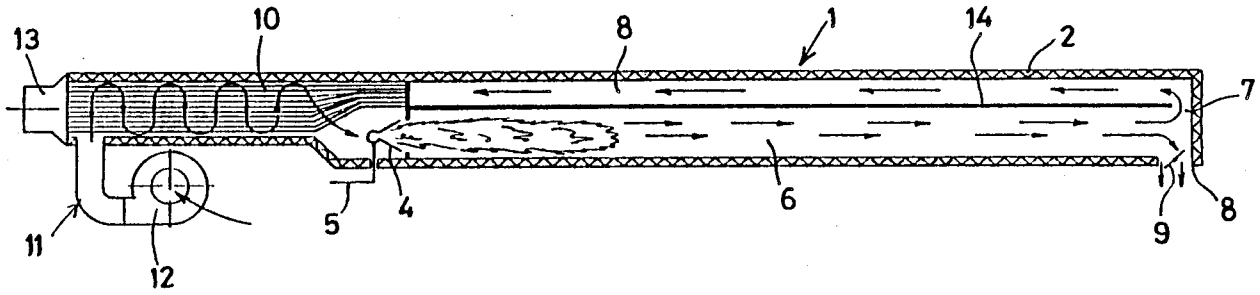
13
10
8
1
14
2
7
11
5
4
6
9
8
12

HEATING APPLIANCE WITH COMBUSTION AIR PREHEAT

BACKGROUND OF THE INVENTION

The present invention relates to a heating appliance, particularly for a drier, comprising a combustion unit having a burner and a combustion chamber.

Such heating appliances are known and are generally used in combination with driers for a web of material in order to heat the atmosphere in said drier and to incinerate the solvent vapours in the exhaust gases. Said known heating appliances are very bulky and require complicated and expensive control and regulating devices.

It is also known to use heating appliances which have so called open burners. Although a good heat transfer is obtained said burners are often a source of soot by insufficiently burning of the solvent vapours. Moreover an additional incinerator has to be arranged for treatment of the exhaust gases.

It is an object of the present invention to provide a heating appliance which is as compact as possible and can be mounted in the drier as a single unit.

Another object of the invention is to provide a heating appliance, the combustion gases of which are clean enough to be discharged into the outside air without any subsequent treatment.

DESCRIPTION OF THE INVENTION

These objects are achieved according to the invention in that the combustion chamber consists of an elongated first portion, extending away from the burner and merging into an elongated second portion via a bend of 180°, said two portions defining an U-shaped path for the combustion gases and being approximately of equal lengths and in that said combustion chamber being provided with at least one discharge opening for discharging part of the combustion gases, said opening(s) being controllable by means of a valve.

The U-shaped configuration of the combustion chamber provides on the one hand a long residence time for the combustion gases which ensures that all harmful substances are burnt to such an extent that emission standards are met on discharging said flue gases as exhaust gases. On the other hand the heating of the atmosphere in the drier takes place directly by the combustion gases which are discharged via the discharge opening or openings.

DESCRIPTION OF THE PREFERRED EMBODIMENT

The invention will be explained in more detail with reference to the accompanying drawing, which shows a schematical sectional view of the heating appliance according to the invention.

The heating appliance 1 comprises an essentially closed housing 2 having an elongated configuration. Inside said housing a burner 4 is disposed having a fuel supply 5.

Also inside said housing a combustion chamber is defined consisting of a first elongated portion 6 merging via a bend 7 into a second elongated portion 8. Both parties define a U-shaped path for the combustion gases.

In the first portion of the combustion chamber near the bend 7 a discharge opening 8 is arranged, said opening being provided with a valve 9. If desired, more than one discharge opening may be arranged in any suitable location of the combustion chamber.

The second portion 8 of the combustion chamber is connected with a heat exchanger 10, through which also flows combustion air for the burner 4, which is supplied via air intake means 11 including a fan 12.

Via the heat exchanger 10 the second portion of the combustion chamber is in communication with an outlet 13 for discharging the combustion gases to the outside air.

As can be seen from the drawing the heating appliance has a very compact elongated configuration in which the heat exchanger 10 and the combustion chamber 6, 7, 8 are longitudinally aligned and enclosed in the single housing 2, which has for example a rectangular cross section, the heat exchanger 10 lying within the outer contours of the combustion chamber.

The compact arrangement of the heating appliance is also the consequence of the fact that the cross sectional area of the combustion chamber can be made smaller after the discharge opening(s) because the combustion gases throughput decreases. In the embodiment shown in the drawing the second portion 8 of the combustion chamber has a smaller cross sectional area. Since the mass of the combustion gases passing the heat exchanger is smaller said heat exchanger can also have a reduced volume.

The U-shaped path for the combustion gases within the combustion chamber provides a certain residence time for said combustion gases so that the combustion gases are maintained at a high temperature of approximately 700–800° C.

The residence time can be chosen by choosing a particular volume of the combustion chamber, while the temperature of the combustion gases can be controlled by controlling the fuel supply to the burner 4. Therefore all harmful substances and vapours are oxidized so that the combustion gases can be discharged without any subsequent treatment, by a suitable choice of a residence time-temperature combination.

Through the discharge opening 8 part of the combustion gases are discharged for heating purposes. The quantity of the discharged combustion gases is controlled by means of the valve 9.

In the shown embodiment the opening 8 is located in the first portion 6 near the bend 7. It will however be appreciated that said opening can be situated somewhere else for example in the second portion of the combustion chamber.

The U-shaped path within the combustion chamber is defined by a plate 14, which extends longitudinally in the combustion chamber and forms the two portions 6 and 8 of approximately the same length.

What is claimed is:

1. A heating appliance for a drier, comprising a combustion unit having a burner and a combustion chamber, wherein said combustion chamber comprises an elongated first portion, extending away from said burner and merging into an elongated second portion via a bend of 180°, said two portions and said bend defining a U-shaped path for combustion gases and said portions being approximately of equal lengths and said combustion chamber being provided with at least one discharge opening for discharging part of said combustion gases, said opening being located in said combustion chamber prior to said second portion and being controllable by means of a valve.

2. A heating appliance according to claim 1, wherein said opening is located in said first portion of said combustion chamber.

3. A heating appliance according to claim 1, further comprising said burner including an air intake, a heat exchanger in communication with said air intake for said burner and said combustion gases for preheating said air intake.

4. A heating appliance according to claim 3, wherein said heat exchanger is disposed in longitudinal alignment with said combustion chamber and lies within the outer contours of said combustion chamber.

5. A heating appliance according to claim 1, wherein said combustion chamber comprises an elongated housing having a rectangular cross section and said portions and said U-shaped path for said combustion gases are defined by said housing and by a longitudinally extending plate disposed inside said housing.

* * * * *